United States Patent [19]

Kronich

[11] Patent Number: 4,881,496

[45] Date of Patent: Nov. 21, 1989

[54] VALVE MECHANISM LUBRICATION SYSTEM FOR HORIZONTAL CYLINDER OVERHEAD VALVE ENGINE

[75] Inventor: Peter G. Kronich, Sheboygan, Wis.

[73] Assignee: Tecumseh Products Company, Tecumseh, Mich.

[21] Appl. No.: 196,979

[22] Filed: May 20, 1988

[51] Int. Cl.[4] ..... F01M 9/10; F01M 13/02; F01M 11/02

[52] U.S. Cl. ..... 123/90.33; 123/106 W

[58] Field of Search ..... 123/90.33, 90.34, 41.86, 123/196 W, 196 CP; 184/6.18

[56] References Cited

U.S. PATENT DOCUMENTS

| | | | |
|---|---|---|---|
| 1,277,178 | 8/1918 | Bernhard . | |
| 2,366,701 | 1/1945 | Doman . | |
| 2,902,022 | 9/1959 | Bakke et al. . | |
| 3,144,097 | 8/1964 | Ebert . | |
| 4,513,702 | 4/1985 | Koga et al. . | |
| 4,601,267 | 7/1986 | Kronich . | |
| 4,611,559 | 9/1986 | Sumigawa | 123/196 W |
| 4,662,322 | 5/1987 | Tamba et al. . | |
| 4,688,529 | 8/1987 | Mitadera et al. . | |
| 4,771,745 | 9/1988 | Nakamura et al. | 123/90.33 |
| 4,790,273 | 12/1988 | Oguri et al. | 123/196 W |
| 4,825,825 | 5/1989 | Chino et al. | 123/196 W |

*Primary Examiner*—Willis R. Wolfe
*Assistant Examiner*—M. Macy
*Attorney, Agent, or Firm*—Albert L. Jeffers; John F. Hoffman

[57] ABSTRACT

A lubrication system for the valve actuating mechanism of an internal combustion engine having a vertical drive shaft and horizontally oriented cylinder includes a rocker box housing the valve actuating mechanism with the valve actuating mechanism including a lower rocker arm and an upper rocker arm each oriented for rocking in a substantially horizontal rocking plane. A push rod cavity communicates at one end with the crankcase and at the other end with the rocker box. A cam shaft gear disposed at a lower end of a vertical cam shaft slings liquid oil from the crankcase through the push rod cavity into the rocker box. A dam is provided for retaining liquid oil in the rocker box at a level which partially submerges the lower rocker arm such that the rocking motion of the lower rocker arm splashes dammed oil to lubricate the valve actuating mechanism.

20 Claims, 2 Drawing Sheets

VALVE MECHANISM LUBRICATION SYSTEM FOR HORIZONTAL CYLINDER OVERHEAD VALVE ENGINE

BACKGROUND OF THE INVENTION

This invention relates generally to a lubrication system for the upper valve mechanism of an overhead valve engine having a horizontally disposed cylinder and vertical crankshaft.

Prior vertical crankshaft engines have included a pressure lubrication system for the upper valve mechanism utilizing crankcase breather induction of oil mist in a counter flow through two separate push rod tubes with the feeder push rod tube directly connected to the engine crankcase and the return push rod tube connected to the engine breather box which vents through a breather mechanism to the atmosphere. This lubrication system causes oil mist from the crankcase to flow up one push rod tube, circulate within the cylinder head rocker box to lubricate the valve mechanism, and then be induced by the crankcase breather into the breather box where the liquid oil is separated from the vapors. The liquid oil drains back into the crankcase and the vapors are vented to the atmosphere through the breather mechanism. Such a system is shown in U.S. Pat. No. 4,601,267.

Another prior lubrication system for an overhead valve internal combustion engine having a horizontal cylinder and also a horizontal crankshaft utilizes the oil leakage from a hydraulic valve lifter actuated by a horizontal cam shaft to pump oil through a push rod tube into one side of a rocker box divided by a vertical baffle. The rocker arms are oriented vertically on either side of the baffle. One of the rocker arms has an end in engagement with the push rod, which end is submerged in a pool of accumulated oil in the rocker box. By splashing and overflow the pool of oil in the one side of the rocker box crosses the vertical baffle to the other side of the rocker box containing the other vertically oriented rocker arm to also lubricate that side of the valve mechanism. Such a lubrication system is shown in U.S. Pat. No. 2,366,701.

SUMMARY OF THE INVENTION

The present invention involves an overhead valve engine in which a centrifugal oil slinger in the crankcase slings oil through a push rod cavity in communication with the crankcase at one end and in communication with the rocker box at the other end. The rocker arms in the rocker box are disposed one above the other, each oriented for rocking in a substantially horizontal plane. A dam is provided for restraining oil slung into the rocker box at a level such that the lower rocker arm is partially submerged in a pool of liquid oil.

One advantage of the present invention is the provision of an improved lubrication system for the upper valve mechanism of an overhead valve internal combustion engine without requiring the use of breather induction. This is particularly useful where the breather mechanism of the engine is located within the crankcase of the engine and therefore cannot be used to induce a flow of oil mist. In such applications, the present invention provides a workable alternative to the prior art lubrication system first mentioned above.

Another advantage of the present invention is the provision of an improved lubrication system for the upper valve mechanism of an overhead valve engine which does not depend upon hydraulic valve lifters for delivery of oil to the rocker box and which by reason of the orientation of the rocker arms within the rocker box provides more vigorous and thorough splashing of oil within the rocker box to lubricate the upper valve mechanism. The present invention therefore constitutes an improvement over the second mentioned prior art lubrication system above.

The invention, in one form thereof, provides a lubrication system for the valve actuating mechanism of an internal combustion engine including a crankcase and a cam shaft disposed in the crankcase. A rocker box houses the valve actuating mechanism with the valve actuating mechanism including a lower rocker arm and an upper rocker arm with the lower rocker arm disposed for rocking in a substantially horizontal rocking plane. A push rod cavity communicates at one end with the crankcase and at the other end with the rocker box. Oil slinger means are disposed in driving engagement with the cam shaft for slinging liquid oil from the crankcase through the push rod cavity into the rocker box. Dam means are provided for retaining liquid oil in the rocker box at a level which partially submerges the lower rocker arm.

It is a feature of the present invention to provide a horizontally disposed rocker arm partially submerged in a pool of oil in the rocker box of an internal combustion engine to provide improved splash lubrication of the upper valve mechanism.

It is a further feature of the present invention to provide oil slinging means for slinging oil from the crankcase of an internal combustion engine through a push rod cavity into the rocker box.

Yet a further feature of the present invention involves dam means disposed for retaining oil slung into the rocker box at a level such that the lower rocker arm is partially submerged.

Further features and advantages of the present invention will become apparent from the following description.

DESCRIPTION OF THE PREFERRED EMBODIMENT

Figure 1:
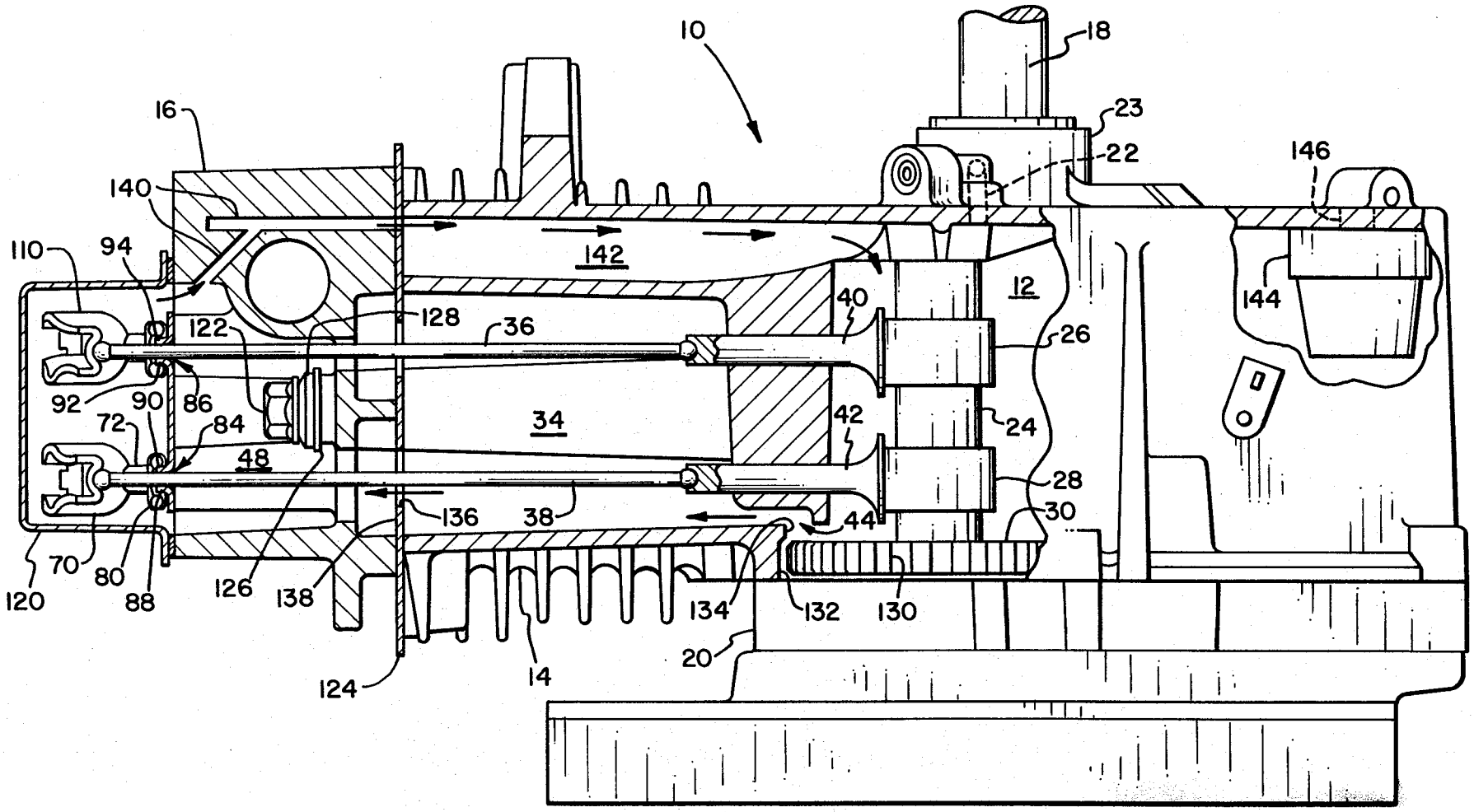
FIG. 1 is a partial sectional view of an overhead valve internal combustion engine having a vertical shaft.
Figure 2:
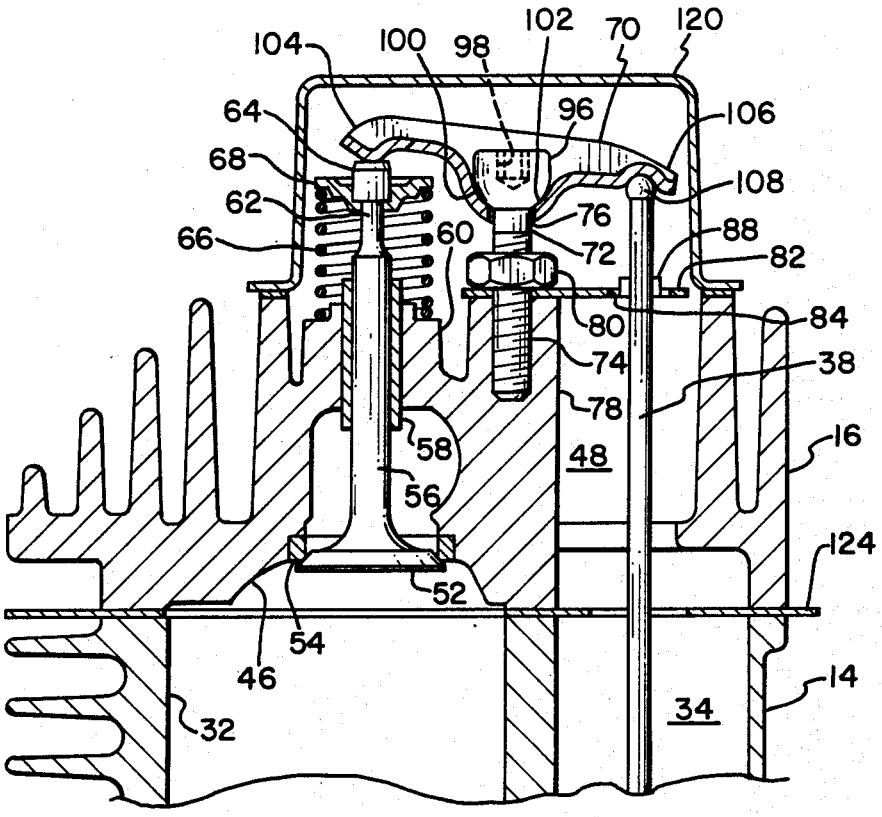
FIG. 2 is a sectional view of the cylinder head portion of the engine of FIG. 1 taken along a plane defined by the push rod and valve stem of the lower rocker arm of FIG. 1.
Figure 3:
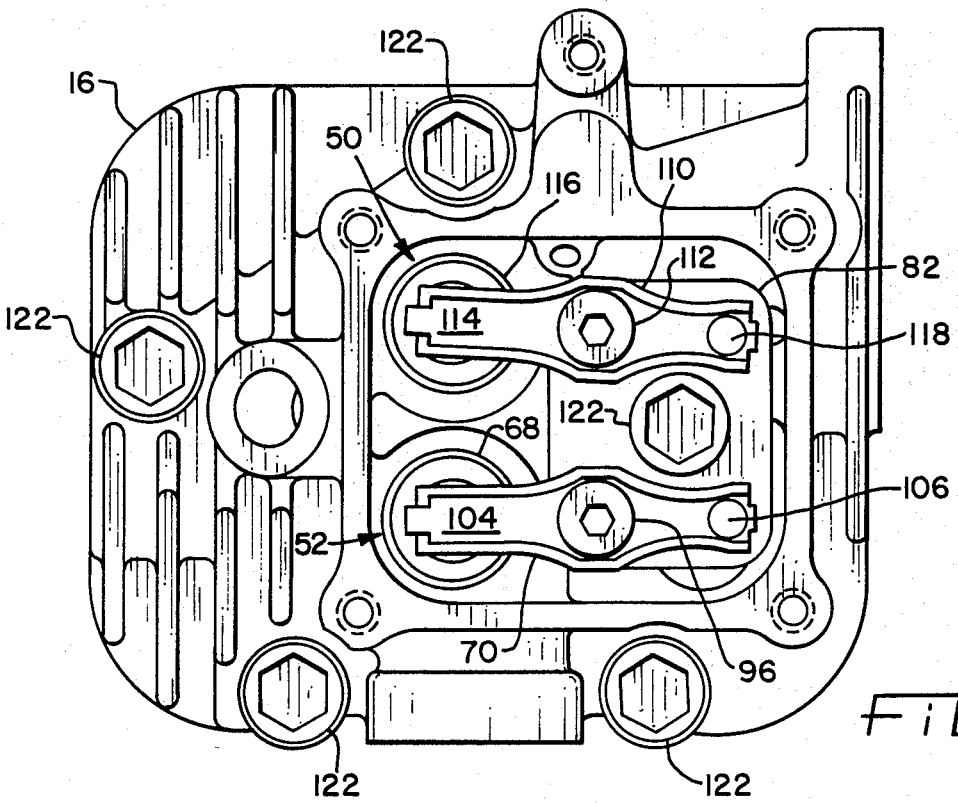
FIG. 3 is an end view of the cylinder head portion of the engine of FIG. 1 with the rocker box removed.

Referring to the drawings, there is illustrated an air cooled overhead valve internal combustion engine 10 having a crankcase 12 with an integral cylinder portion 14 and a cylinder head 16. Crankcase 12 includes a vertical output shaft 18 journalled therein and extending therefrom and connected to a conventional vertical crankshaft and horizontally disposed piston (not shown). An oil sump 20 including an oil pump provides lubricating oil to the moving parts in the crankcase in part by spraying oil from spray hole 22 in communication with the upper crankshaft journal 23. A vertical cam shaft 24 is journalled within crankcase 12 and includes an upper cam 26 corresponding to the intake valve and a lower cam 28 corresponding to the exhaust valve. Cam shaft 24 is driven by cam gear 30 connected at the lower end of cam shaft 24. Cam gear 30 is itself driven by a gear train (not shown) connected to the crankshaft in suitable fashion for proper valve timing.

Cylinder portion 14 includes cylinder bore 32 in which a piston reciprocates and an integral cast push rod cavity 34 housing a pair of push rods 36 and 38 driven reciprocally by tappets 40 and 42 which engage cams 26 and 28 respectively. Push rod cavity 34 communicates with crankcase 12 at one end thereof via oil pick-up passage 44 adjacent the periphery of cam gear 30.

Cylinder head 16 includes a combustion chamber 46 aligned with and in communication with cylinder bore 32, and a push rod cavity 48. Intake valve 50 and exhaust valve 52 provide for selective communication between combustion chamber 46 and corresponding intake and exhaust ports.

Exhaust valve 52 is shown seated on valve seat 54 in cylinder head 16. Exhaust valve 52 includes valve stem 56 slidingly received in bearing bushing 58 fitted within boss 60 of cylinder head 16. Valve stem 56 includes a reduced neck portion 62 and an end portion 64. Exhaust valve spring 66 engages boss 60 at one end thereof and valve spring keeper 68 at the other end thereof. Valve spring keeper 68 engages the underside of end portion 64 adjacent neck portion 62, with exhaust valve spring 68 disposed in compression between boss 60 and valve end portion 64, whereby exhaust valve 52 is urged against valve seat 54. Intake valve 50 is constructed and arranged similarly.

Exhaust valve rocker arm 70 is pivotally mounted to rocker arm stud 72 which has a threaded shank 74 received through an elongate hole 76 in the bottom of rocker arm 70. Threaded shank 74 is threadedly received in rocker arm support boss 78 of cylinder head 16. A hex-faced jam nut 80 is threadedly received about shank 74 of rocker arm stud 72 above support boss 78 and can be tightened with respect to support boss 78 to secure rocker arm stud 72 thereto.

Sandwiched between support boss 78 and jam nut 80 is push rod guide plate 82. Guide plate 82 includes a pair of push rod apertures 84 and 86 positioned for receiving push rod 38 corresponding to exhaust valve 52 and push rod 36 corresponding to intake valve 50, respectively. Upstanding from the plane of guide plate 82 adjacent aperture 84 are push rod guide tabs 88 and 90. Likewise, similarly shaped push rod guide tabs 92 and 94 are associated with push rod aperture 86. Each pair of guide tabs 88 and 90, and 92 and 94 are disposed on either side of a respective push rod. In this orientation, lateral movement of the push rods perpendicular to the rocking plane of the rocker arms is restricted while lateral movement of the push rods in the rocking plane of the rocker arms incidental to the rocking motion of the rocking arms is permitted.

Rocker arm stud 72 includes an enlarged head portion 96 forged integrally with shank 74 and having a hexagonally shaped recess 98 extending downwardly into head portion 96 coaxially with the axis of shank 74. Head portion 96 further includes a spherically shaped under surface 100 in engagement with a correspondingly shaped bearing surface 102 of rocker arm 70. Rocker arm 70 includes an end 104 in engagement with the top end portion 64 of valve 52. Opposite end 106 of rocker arm 70 engages ball shaped end 108 of push rod 38. The structure corresponding to the upper intake valve train is correspondingly similar to the valve train associated with exhaust valve 52 as described in detail above, including an intake rocker arm 110 pivotally mounted to a rocker arm stud 112 and including an end 114 engaging intake valve assembly 116 and an opposite end 118 engaging push rod 36. The valve actuating mechanism including lower exhaust valve rocker arm 70 and upper intake valve rocker arm 110 and their associated valve springs are housed within rocker box 120 disposed at the top of cylinder head 16.

Cylinder head 16 is attached to cylinder portion 14 by five cylinder head bolts 122. A metal cylinder head gasket 124 made of a soft aluminum alloy is disposed between cylinder head 16 and cylinder portion 14 to provide a high pressure seal at their interface. Head gasket 124 preferably includes annular ribs surrounding cylinder bore 32 which protrude out of the plane of the gasket to improve sealing effectiveness. Head bolts 122 are received through appropriately sized bores in cylinder head 16 and are threadedly received in a corresponding threaded bore in cylinder portion 14. A flat metal thrust washer 126 is disposed about the shank of head bolt 122 atop cylinder head 16. A dish shaped spring washer 128 is disposed about the shank of head bolt 122 between thrust washer 126 and the underside of the head bolt 122. Head bolts 122 are tightened into cylinder portion 14 sufficiently to partially compress spring washer 128, thereby causing spring washer 128 to maintain substantially constant compressive force on metal head gasket 124 despite temperature induced expansion and contraction of the metal parts adjacent head gasket 124 throughout thermal cycling of the engine.

Referring in particular to FIG. 1, cam gear 30 is situated such that during rotation lubricating oil delivered to the crankcase from oil sump 20 and through oil spray hole 22 is slung by centrifugal force and the action of gear teeth 130 against end wall 132 of crankcase 12 and thence upwardly over lip 134 into oil pickup passage 44. Oil slung in such fashion by cam gear 30 builds up in the lower portion of push rod cavity 34 and eventually reaches a depth sufficient to flow through aperture 136 in gasket 124 which is the aperture through which push rod 38 passes from cylinder portion 14 into cylinder head 16. That portion 138 of head gasket 124 located below aperture 136 acts as a dam for oil which has passed through aperture 136 into push rod cavity 48. The height of dam 138 is such that a pool of oil accumulates in rocker box 120 to a depth such that exhaust valve rocker arm 70 and its associated valve spring 66 are partially submerged. The reciprocal motion of push rod 38 induced by cam 28 of cam shaft 24 causes lower rocker arm 70 to pivot on rocker arm stud 72 in a substantially horizontal rocking plane. The rocking of the partially submerged rocker arm 70 and valve spring 66 generates great turbulence in the accumulated pool of lubricating oil within rocker box 120, thereby causing splash lubrication of upper rocker arm 110 and its associated valve assembly 116 by placing oil in suspension with air in rocker box 120. Excess oil in push rod cavity 48 and rocker box 120 drains back into crankcase 12 through aperture 136 and oil pick-up passage 44 such that oil is maintained at a substantially constant, although turbulent, level in rocker box 120 during operation of engine 10. When engine 10 is stopped, oil in rocker box 120 and push rod cavity 48 of cylinder head 16 drains back into the sump 20 of crankcase 12 through oil pick-up passage 44, with a portion of the oil remaining dammed up in rocker box 120 and push rod cavity 48 behind dam 138.

To avoid the build-up of back pressure in rocker box 120 which might prevent the flow of liquid oil therein from cam gear slinger 30 into rocker box 120, vent passageway 140 in cylinder head 16 communicates with the upper portion of rocker box 120 and communicates with crankcase 12 via passage 142. Crankcase 12 is vented to atmosphere through oil separator 144 located inside crankcase 12 through vent aperture 146.

While this invention has been described as having a preferred design, it will be understood that it is capable of further modification. This application is therefore intended to cover any variations, uses, or adaptations of the invention, following the general principles thereof and including such departures from the present disclosure as come within known or customary practice in the art to which this invention pertains and fall within the limits of the appended claims.

What is claimed is:

1. A lubrication system for the valve actuating mechanism of an overhead valve, horizontal cylinder internal combustion engine comprising:

a crankcase having lubricating oil therein;

a rocker box housing said valve actuating mechanism, said valve actuating mechanism including a lower rocker arm and an upper rocker arm with the lower rocker arm disposed for rocking in a substantially horizontal rocking plane;

a push rod cavity communicating at one end with said crankcase and at another end with said rocker box; and oil slinger means for slinging liquid oil from said crankcase through said push rod cavity into said rocker box such that the lower rocker arm is at least partially submerged.

2. The lubrication system of claim 1, in which said valve actuating mechanism includes a valve spring reciprocated by the lower rocker arm and positioned such that the valve spring is at least partially submerged in oil in said rocker box.

3. A lubrication system of claim 1, and further including dam means for retaining liquid oil in said rocker box at a level which at least partially submerges the lower rocker arm.

4. The lubrication system of claim 3, in which said dam means is located in said push rod cavity.

5. The lubrication system of claim 4, and further including a cylinder head disposed between said rocker box and said crankcase, a head gasket disposed between said cylinder head and said crankcase, said dam means including said head gasket.

6. The lubrication system of claim 5, in which said head gasket includes an aperture situated in said push rod cavity at a height with respect to the lower rocker arm such that a portion of said head gasket below said aperture comprises said dam means.

7. The lubrication system of claim 3, in which said valve actuating mechanism includes a valve spring reciprocated by the lower rocker arm and positioned such that the valve spring is at least partially submerged in oil in said rocker box.

8. The lubrication system of claim 1, and further including vent means for venting said rocker box to said crankcase.

9. The lubrication system of claim 3, and further including vent means for venting said rocker box to said crankcase.

10. A lubrication system for the valve actuating mechanism of an overhead valve, horizontal cylinder internal combustion engine comprising:

a crankcase having lubricating oil therein;

a camshaft disposed in said crankcase;

a rocker box housing said valve actuating mechanism;

a push rod cavity communicating at one end with said crankcase and at another end with said rocker box; and oil slinger means for slinging liquid oil from said crankcase through said push rod cavity into said rocker box.

11. The lubrication system of claim 10, in which said oil slinger means includes a cam gear connected to said cam shaft with the cam gear slinging oil centrifugally therefrom.

12. The lubrication system of claim 11, in which said cam gear is disposed for rotation about a substantially vertical axis, said push rod cavity communicating with said crankcase via an oil pickup passageway located adjacent and above the periphery of said cam gear.

13. The lubrication system of claim 12, in which said valve actuating mechanism includes a lower rocker arm and an upper rocker arm with the lower rocker arm disposed for rocking in a substantially horizontal rocking plane.

14. The lubrication system of claim 13, and further including dam means for retaining liquid oil in said rocker box at a level which at least partially submerges the lower rocker arm.

15. The lubrication system of claim 14, and further including vent means for venting said rocker box to said crankcase.

16. The lubrication system of claim 14, in which said dam means is located in said push rod cavity.

17. The lubrication system of claim 16, and further including a cylinder head disposed between said rocker box and said crankcase a head gasket disposed between said cylinder head and said crankcase, said dam means including said head gasket.

18. The lubrication system of claim 14, in which said valve actuating mechanism includes a valve spring reciprocated by the lower rocker arm and positioned such that the valve spring is at least partially submerged in oil in said rocker box.

19. The lubrication system of claim 18, and further including a cylinder head disposed between said rocker box and said crankcase, a head gasket disposed between said cylinder head and said crankcase, said dam means including said head gasket.

20. The lubrication system of claim 19, in which said head gasket includes an aperture situated in said push rod cavity at a height with respect to the lower rocker arm such that a portion of said head gasket below said aperture comprises said dam means.

* * * * *